US012507749B2

(12) United States Patent
Park et al.

(10) Patent No.: US 12,507,749 B2
(45) Date of Patent: Dec. 30, 2025

(54) BREATHABLE, STRETCHABLE WADER LEG, AND WADER GARMENT WITH BREATHABLE, STRETCHABLE LEGS

(71) Applicant: Bass Pro Intellectual Property, L.L.C., Springfield, MO (US)

(72) Inventors: Jinwoo Park, Springfield, MO (US); Caitlin E. Powell, Springfield, MO (US)

(73) Assignee: Bass Pro Intellectual Property, L.L.C., Springfield, MO (US)

( * ) Notice: Subject to any disclaimer, the term of this patent is extended or adjusted under 35 U.S.C. 154(b) by 17 days.

(21) Appl. No.: 17/829,217

(22) Filed: May 31, 2022

(65) Prior Publication Data

US 2023/0380521 A1 Nov. 30, 2023

(51) Int. Cl.

| | |
|---|---|
| ***A41D 13/00*** | (2006.01) |
| ***A41D 13/02*** | (2006.01) |
| ***A41D 31/102*** | (2019.01) |

(52) U.S. Cl.

CPC ..... *A41D 13/02* (2013.01); *A41D 31/102* (2019.02)

(58) Field of Classification Search

CPC ..... A41D 13/02; A41D 13/102

See application file for complete search history.

(56) References Cited

U.S. PATENT DOCUMENTS

| | | | | | |
|---|---|---|---|---|---|
| 2,679,647 | A * | 6/1954 | Gossner | A43B 23/06 | 2/84 |
| 2,749,551 | A * | 6/1956 | Garbellano | B63C 11/04 | 29/33 P |
| 5,081,718 | A * | 1/1992 | Carman | A41D 13/02 | 2/82 |
| 5,219,367 | A * | 6/1993 | Fields | A62B 17/001 | 2/81 |
| 5,247,708 | A * | 9/1993 | Freese, Jr. | A62B 17/001 | 2/81 |
| 5,711,031 | A * | 1/1998 | Clement | A41D 1/08 | 2/82 |
| 5,901,374 | A * | 5/1999 | Foster | A41D 13/012 | 2/242 |
| 6,154,884 | A * | 12/2000 | Dehner | A41D 13/02 | 2/82 |
| 6,167,571 | B1 * | 1/2001 | Cheng | A41D 13/02 | 2/87 |
| 6,317,893 | B1 * | 11/2001 | Walton | A41D 27/04 | 2/82 |
| 7,707,658 | B2 * | 5/2010 | Culhane | A41D 3/00 | 2/227 |
| 7,770,235 | B2 * | 8/2010 | Lepage | B29C 66/43 | 2/82 |
| 8,819,864 | B2 | 9/2014 | Hare | | |
| D735,445 | S | 8/2015 | Hare | | |
| 10,362,814 | B2 * | 7/2019 | North | A41D 1/06 | |
| 2004/0133960 | A1 * | 7/2004 | Rausch | A41D 13/02 | 2/69 |

(Continued)

*Primary Examiner* — Richale L Quinn

(74) *Attorney, Agent, or Firm* — Dinsmore & Shohl LLP

(57) ABSTRACT

A leg portion for a wader garment, the leg portion comprising a ply of whose opposite edge margins are joined by an upper seam and a lower seam on the front of the leg to form a tube. There is an opening in the front of the leg portion between the bottom of the top seam and the top of the bottom seam, and a panel of a breathable, material sealing secured over the opening.

18 Claims, 2 Drawing Sheets

(56) References Cited

U.S. PATENT DOCUMENTS

Figure 1:
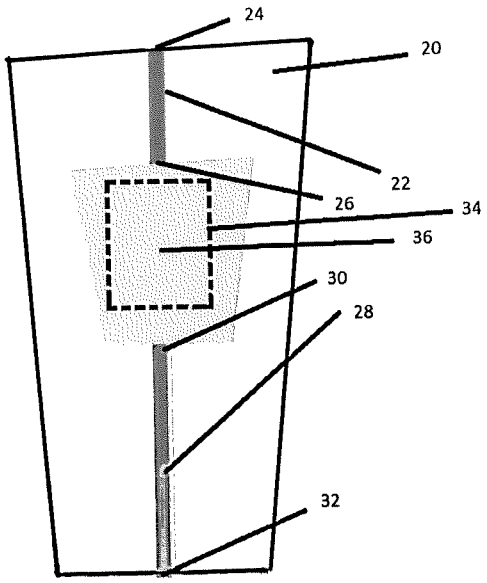

| | | | | |
|---|---|---|---|---|
| 2007/0082189 | A1* | 4/2007 | Gillette | B32B 5/18 442/373 |
| 2008/0250551 | A1* | 10/2008 | Mazzarolo | A41D 13/02 2/243.1 |
| 2010/0306897 | A1* | 12/2010 | Wood | A41F 15/002 2/82 |
| 2020/0196688 | A1* | 6/2020 | Beernink | A41D 13/012 |
| 2021/0161222 | A1* | 6/2021 | Krull | A41D 31/102 |
| 2022/0287394 | A1* | 9/2022 | Elliff | B63C 9/08 |

* cited by examiner

BREATHABLE, STRETCHABLE WADER LEG, AND WADER GARMENT WITH BREATHABLE, STRETCHABLE LEGS

FIELD

The present disclosure relates to breathable, stretchable wader leg, and wader garment with breathable, stretchable legs.

BACKGROUND

This section provides background information related to the present disclosure which is not necessarily prior art.

Waders are used by hunters and fishermen to more comfortably stand in and walk in water. Conventional waders are generally made of a relatively stiff waterproof material, and thus there is a demand for a more comfortable, stretchable, breathable wader. Waders have been made from breathable materials, but these materials generally cannot stretch to accommodate movement of the wearer. Thus, some breathable wader designs employ an articulated leg pattern to improve wearer more comfort. However, these designs typically have extensive stitching patterns that can be expensive to manufacture, and increase the risk of leakage. Other breathable wader designs use excess material to provide extra room for the wearers to bend and flex their legs, but this makes the waders bulkier, and can increase the cost of manufacture.

SUMMARY

This section provides a general summary of the disclosure, and is not a comprehensive disclosure of its full scope or all of its features.

Embodiments of the present invention provide waders that are more comfortable, stretchable, and/or breathable than conventional waders.

According to one embodiment, a leg construction is provided for a wader. Each leg is generally tubular, being formed of a ply of material joined to itself along an upper seam on the front of the leg, extending from the top of the leg to a point corresponding to a point above the wearer's knee, and a lower seam on the front of the leg, extending from a point corresponding to a point below the wearer's knee to the bottom of the leg. There is an opening in the front of the leg between the upper and lower seams. A panel of a flexible, stretchable, water-resistant material is sealingly secured over the opening in the front of the leg, to impart stretchability to accommodate movement of the wearer's legs.

According to another embodiment, a wader garment adapted to be worn over the legs and torso of the wearer, comprises interconnected upper and lower sections, the upper section for covering at least the lower portion of the wearer's torso, and the lower section including a pair of tubular legs extending from the upper section, for covering the wearer's legs. Each tubular leg is formed of a ply of flexible, breathable material joined to itself along an upper seam on the front of the leg, extending from the top of the leg to a point corresponding to a point above the wearer's knee, and a lower seam on the front of the leg, extending from a point corresponding to a point below the wearer's knee to the bottom of the leg. There is an opening in the front of the leg between the upper and lower seams, and a panel of a flexible, stretchable water resistant breathable material is sealing secured over the opening in the front of the leg, to impart stretchability to accommodate movement of the wearer's legs.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2:
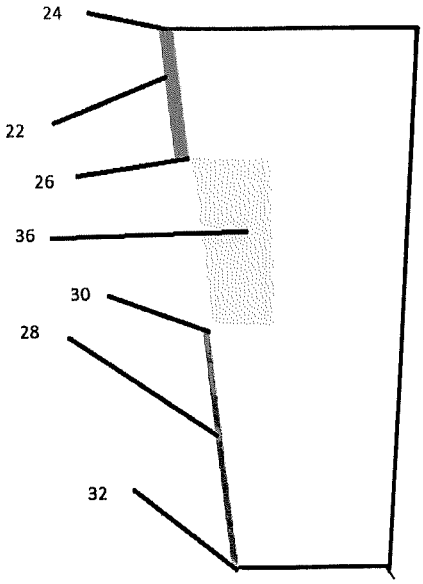
Figure 3:
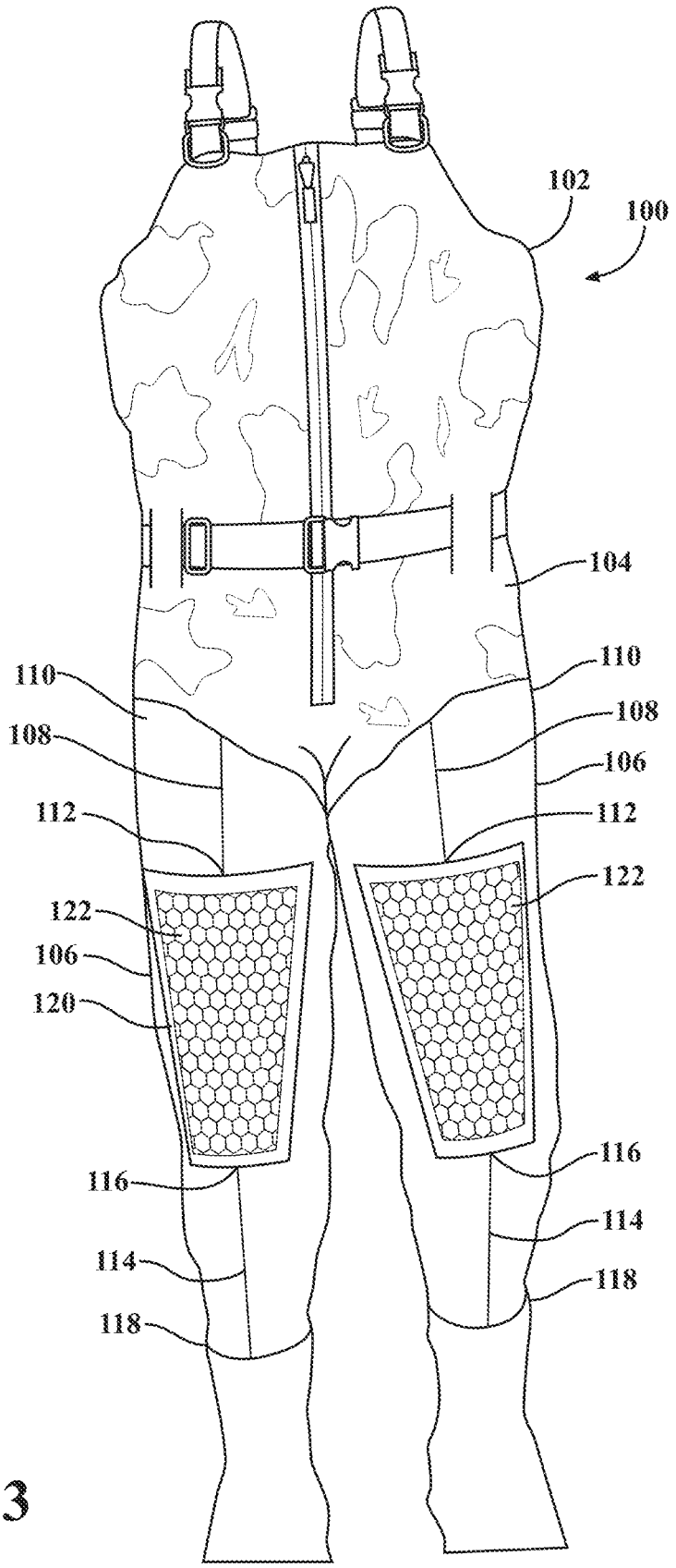

FIG. 1 is a front elevation diagram of one possible embodiment of a breathable, stretchable leg construction for waders according to the principle of this disclosure; and FIG. 2 is a side elevation diagram of the leg construction shown in FIG. 1; and FIG. 3 is a front view of one possible embodiment of wader garment with breathable, stretchable legs.

Corresponding reference numerals indicate corresponding parts throughout the several views of the drawings.

DETAILED DESCRIPTION

Example embodiments will now be described more fully with reference to the accompanying drawings.

Some embodiments of this invention provide a leg construction for waders. In one such leg construction, a leg 20 is formed of a ply of flexible, breathable material joined to itself along an upper seam 22 on the front of the leg, extending from the top 24 of the leg to a point 26 corresponding to a point above the wearer's knee, and a lower seam 28 on the front of the leg, extending from a point 30 corresponding to a point below the wearer's knee to the bottom 32 of the leg. The material is preferably a conventional synthetic, waterproof, breathable material, that is thin and flexible, but non-stretchable. There is an opening 34 in the front of the leg between the upper and lower seams 22 and 28. The opening is shown as being generally rectangular, but it could be of some other shape. The opening 34 simply must be of sufficient size and shape that the a panel mounted over the opening can impart stretchability to accommodate movement of the wearer's legs. A panel 36 of a flexible, stretchable or resilient, water waterproof material, such as neoprene or other suitable polymeric material, is sealingly secured over the opening 34 in the front of the leg 20.

This panel 36 allows the knee portion of the legs 20 to stretch, making it easier for the wearer to bend his or her knees. The panel 36 preferably has a trapezoidal shape, being wider at the top edge than at the bottom edge, to provide more flexing and stretching at the top edge. Of course, the panel 36 could be some other shape, as long as it provides sufficient flexibility and stretch to accommodate the movement and bending of the wearer's legs and adequately covers the opening 34. The panel 36 can also provide some cushioning of the knee when the wearer is kneeling.

The panels 36 can be joined to their respective legs 20 by stitching and double seam taping on the inside and outside surfaces to maintain water tightness. In addition to, or instead of stitching, adhesive, heat sealing, or any other suitable means, or combination of such means can be used to secure the panel 36.

Other embodiments of this invention provide a wader garment. In one such wader garment construction, a wader 100 is adapted to be worn over the legs and at least a portion of the torso of the wearer, and has an improved leg construction compared with conventional leg construction. The wader garment 100 comprises interconnected upper and lower sections 102 and 104. The upper section 102 for covering at least the lower portion of the wearer's torso. The lower section 104 includes a pair of generally tubular legs 106 extending from the upper section, for covering the wearer's legs. Each tubular leg 106 is formed of a ply of flexible, breathable material whose edge margins are joined to itself along an upper seam 108 on the front of the leg, extending from the top 110 of the leg to a point 112 corresponding to a point above the wearer's knee, and a lower seam 114 on the front of the leg 106, extending from a point 116 corresponding to a point below the wearer's knee to the bottom 118 of the leg. The material is preferably a conventional synthetic, waterproof, breathable material, that is thin and flexible, but non-stretchable. There is an opening 120 in the front of the leg between the upper and lower seams 108 and 114. The opening 120 is shown as being generally rectangular, but it could be of some other shape. The opening 120 simply must be of sufficient size and shape that a panel mounted over the opening can provide enhanced flexibility. It is also desirable that the material, and in particular the seam not overlap the wearer's knee, so that the material does not cause discomfort to the wearer's knee when the wearer bends his or her legs or kneels. A panel 122 of a flexible, stretchable or resilient, water waterproof material, such as neoprene or other suitable polymeric material is sealing secured over the opening 120 in the front of the leg. This panel 122 allows the knee portion of the legs 106 to stretch, making it easier for the wearer to bend his or her knees. The panel 122 preferably has a trapezoidal shape, being wider at the top edge than at the bottom edge, to provide more flexing and stretching at the top edge. Of course, the panel 122 could be some other shape, as long as it provides sufficient flexibility and stretch to accommodate the movement and bending of the wearer's legs and adequately covers the opening 120.

The panel 122 can also provide some cushioning of the knee when the wearer is kneeling. The panels 122 can be joined to their respective legs 106 by stitching and double seam taping on the inside and outside surfaces to maintain water tightness. In addition to, or instead of stitching, adhesive, heat sealing, or any other suitable means, or combination of such means can be used to secure the panel 36.

Of course other portions of the upper or lower portions of the waders can be provided with openings and covered with stretchable panels to improve flexibility of the waders. For example, in the seat or under the arms.

Operation

In use, a wearer puts on the wader with the legs 20 or the wader 100 with the tubular legs 106, such that the panels 36 in legs 20, or panels 122 in legs 106 are aligned with the knee, the upper and lower seams 22 and 28 in the legs 20, and 108 and 114 in legs 106 extend along the front of the leg, and in particular, along the wearer's thigh and shin, respectively. This location of the seams, which are generally stiffer than the remainder of the leg portions, interfere the least with the movement of the wearer's legs. The panels 26 in legs 20, and 133 in legs 106 allow the knees of the legs 20 and 106 to stretch, to accommodate the bending of the wearer's knees. Thus a breathable waterproof wader can be provided in which, through positioning of the seams and the location of the resilient panels, the wearer's legs can easily and comfortably bend and flex, providing greater comfort and ease of movement than conventional waders, which are either made of a heavier stretchable material that does not breath or made bulkier to provide for movement in breathable materials that do not stretch. The single seam on the front of the leg reduces rubbing which increase durability and long term performance.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A wader garment adapted to be worn over a wearer's legs and torso, the wader garment comprising:

interconnected upper and lower sections, the upper section for covering at least a lower portion of the wearer's torso, and the lower section including a pair of tubular legs extending from the upper section, for covering the wearer's legs, each tubular leg comprising:

a flexible, breathable, non-stretchable waterproof material joined to itself along a seam extending along a length of a front of the tubular leg, a knee portion of the tubular leg located at a knee of the wearer when the wader garment is worn, wherein the seam does not extend over the knee portion, an opening in the front of the tubular leg, and a panel of a breathable, flexible, stretchable, water-resistant material sealingly secured over the opening in the front of the tubular leg, wherein the panel of breathable, flexible, stretchable, water-resistant material extends from at least halfway up a thigh portion of the tubular leg such that a portion of the seam extending below the panel is longer than a portion of the seam extending above the panel.

2. The wader garment according to claim 1, wherein the panel of breathable, flexible, stretchable water-resistant material of each tubular leg is generally trapezoidal, being larger at the top than at the bottom.

3. The wader garment according to claim 1, wherein the panel of breathable, flexible, stretchable water-resistant material of each tubular leg is secured over the opening in each tubular leg with stitching.

4. The wader garment according to claim 1, wherein the panel of breathable, flexible, stretchable, water-resistant material is generally rectangular.

5. The wader garment according to claim 1, wherein the panel of breathable, flexible, stretchable, water-resistant material is a resilient material.

6. The wader garment according to claim 1, wherein the panel of breathable, flexible, stretchable, water-resistant material is neoprene.

7. The wader garment according to claim 1, wherein the panel of breathable, flexible, stretchable, water-resistant material is attached to each tubular leg by one of stitching, an adhesive, or heat sealing.

8. The wader garment according to claim 1, wherein the seam comprises an upper seam extending upward from the knee portion on the front of the tubular leg and a lower seam extending downward from the knee portion on the front of the tubular leg.

9. The wader garment according to claim 8, wherein the upper seam extends to a top of the tubular leg and the lower seam extends to a bottom of the tubular leg.

10. The wader garment of claim 1, wherein the panel of breathable, flexible, stretchable, water-resistant material is trapezoidal in shape being wider at a top edge above the knee when worn than at a lower edge positioned below the knee and spaced from a bottom of the tubular leg.

11. A wader garment adapted to be worn over a wearer's legs and torso, the wader garment comprising:

interconnected upper and lower sections, the upper section for covering at least a lower portion of the wearer's torso, and the lower section including a pair of tubular legs extending from the upper section, for covering the wearer's legs, each tubular leg comprising:

a flexible, breathable, waterproof material joined to itself along a seam extending along a length of a front of the tubular leg, and a knee region of the tubular leg located at a knee of the wearer when the wader garment is worn, wherein the seam does not extend over the knee region, a panel of a breathable, flexible, stretchable, water-resistant material sealing secured to the tubular leg at the knee region in the front of the tubular leg, wherein the panel of breathable, flexible, stretchable, water-resistant material extends from at least halfway up a thigh portion of the tubular leg such that a portion of the seam extending below the panel is longer than a portion of the seam extending above the panel.

12. The wader garment according to claim 11, wherein the panel of breathable, flexible, stretchable, water-resistant material of each tubular leg is generally trapezoidal, being larger at the top than at the bottom.

13. The wader garment according to claim 11, wherein the panel of breathable, flexible, stretchable, water-resistant material of each tubular leg is secured to the leg with stitching.

14. The wader garment according to claim 11, wherein the panel of breathable, flexible, stretchable, water-resistant material is generally rectangular.

15. The wader garment according to claim 11, wherein the panel of breathable, flexible, stretchable, water-resistant material is a resilient material.

16. The wader garment according to claim 11, wherein the panel of breathable, flexible, stretchable, water-resistant material is a neoprene.

17. The wader garment according to claim 11, wherein the seam comprises an upper seam extending upward from the knee region on the front of the tubular leg and a lower seam extending downward from the knee region on the front of the tubular leg.

18. The wader garment according to claim 17, wherein the upper seam extends to a top of the tubular leg and the lower seam extends to a bottom of the tubular leg.

* * * * *